US007545352B2

(12) United States Patent
Kwak et al.

(10) Patent No.: US 7,545,352 B2
(45) Date of Patent: Jun. 9, 2009

(54) LIGHT EMITTING DISPLAY (LED) AND DISPLAY PANEL AND PIXEL CIRCUIT THEREOF

(75) Inventors: Won-Kyu Kwak, Suwon-si (KR); Sung-Chon Park, Suwon-si (KR)

(73) Assignee: Samsung Mobile Display Co., Ltd., Yongin, Gyunggi-Do (KR)

( * ) Notice: Subject to any disclaimer, the term of this patent is extended or adjusted under 35 U.S.C. 154(b) by 730 days.

(21) Appl. No.: 11/184,820

(22) Filed: Jul. 20, 2005

(65) Prior Publication Data

US 2006/0022909 A1 Feb. 2, 2006

(30) Foreign Application Priority Data

Jul. 28, 2004 (KR) ..... 10-2004-0059213

(51) Int. Cl.
*G06F 3/038* (2006.01)

(52) U.S. Cl. ..... 345/82; 345/205; 313/500

(58) Field of Classification Search ..... 345/82, 345/83, 205, 206; 313/500
See application file for complete search history.

(56) References Cited

U.S. PATENT DOCUMENTS

| | | | | |
|---|---|---|---|---|
| 5,854,494 | A | 12/1998 | Yamazaki et al. | |
| 6,421,033 | B1 | 7/2002 | Williams et al. | |
| 6,992,663 | B2 * | 1/2006 | Nakamura et al. | 345/204 |
| 7,224,352 | B2 * | 5/2007 | Lifka et al. | 345/205 |
| 7,259,735 | B2 * | 8/2007 | Kasai | 345/77 |
| 7,259,737 | B2 * | 8/2007 | Ono et al. | 345/82 |
| 7,286,106 | B2 * | 10/2007 | Komiya et al. | 345/82 |
| 7,336,272 | B2 * | 2/2008 | Okamoto | 345/211 |
| 7,339,562 | B2 * | 3/2008 | Ikeda | 345/82 |
| 7,348,944 | B2 * | 3/2008 | Miwa et al. | 345/76 |
| 7,355,572 | B2 * | 4/2008 | Uchino et al. | 345/77 |
| 7,365,713 | B2 * | 4/2008 | Kimura | 345/76 |
| 7,397,450 | B2 * | 7/2008 | Suh et al. | 345/76 |
| 7,403,176 | B2 * | 7/2008 | Chung et al. | 345/76 |
| 2004/0070557 | A1 | 4/2004 | Asano et al. | |

(Continued)

FOREIGN PATENT DOCUMENTS

| | | |
|---|---|---|
| EP | 1 531 450 | 5/2005 |

(Continued)

OTHER PUBLICATIONS

European Office Action of the European Patent Application No. 05106914.4-2205, mailed on Oct. 5, 2005.

*Primary Examiner*—Marvin M Lateef
*Assistant Examiner*—Robert J Kline
(74) *Attorney, Agent, or Firm*—Robert E. Bushnell, Esq.

(57) ABSTRACT

A display panel includes: data lines adapted to transmit a data signal; scan lines adapted to transmit a select signal; and pixels, each pixel being coupled to one of the scan lines and one of the data lines, and each pixel including: light emitting elements adapted to emit light corresponding to a current supplied thereto; a pixel driver adapted to input the data signal while the select signal is being supplied and to output a first current corresponding to the data signal; and switching units adapted to transmit the first current to the light emitting elements, each of the switching units including first transistors respectively coupled between the pixel driver and the light emitting elements, and having different type channels.

19 Claims, 8 Drawing Sheets

U.S. PATENT DOCUMENTS

| | | | | |
|---|---|---|---|---|
| 2005/0275606 | A1* | 12/2005 | Wu | 345/76 |
| 2006/0044245 | A1* | 3/2006 | Park et al. | 345/92 |
| 2006/0077137 | A1* | 4/2006 | Kwon | 345/76 |
| 2006/0077138 | A1* | 4/2006 | Kim | 345/76 |
| 2008/0036704 | A1* | 2/2008 | Kim et al. | 345/76 |

FOREIGN PATENT DOCUMENTS

| | | |
|---|---|---|
| EP | 1 577 871 | 9/2005 |
| JP | 09-138659 | 5/1997 |
| JP | 11-296142 | 10/1999 |
| JP | 2002-244619 | 8/2002 |
| JP | 2003-510661 | 3/2003 |
| JP | 2003-122306 | 4/2003 |
| JP | 2004-133240 | 4/2004 |
| JP | 2005-148750 | 6/2005 |
| JP | 2005-520193 | 7/2005 |
| JP | 3933667 | 3/2007 |
| KR | 10-2005-0046469 | 5/2005 |
| KR | 10-2005-0092207 | 9/2005 |
| KR | 10-2005-0092208 | 9/2005 |
| WO | WO 03/077231 | 9/2003 |

* cited by examiner

LIGHT EMITTING DISPLAY (LED) AND DISPLAY PANEL AND PIXEL CIRCUIT THEREOF

CLAIM OF PRIORITY

This application makes reference to, incorporates the same herein, and claims all benefits accruing under 35 U.S.C. §119 from an application for LIGHT EMITTING DISPLAY, AND DISPLAY PANEL AND PIXEL CIRCUIT THEREOF earlier filed in the Korean Intellectual Property Office on 28 Jul. 2004 and there duly assigned Serial No. 10-2004-0059213.

BACKGROUND OF THE INVENTION

1. Field of the Invention

The present invention relates to a Light Emitting Display (LED), and a display panel and a pixel circuit thereof, and more particularly to an Organic Light Emitting Diode (OLED) display and pixel circuit thereof.

2. Description of the Related Art

In general, an OLED display, which is a kind of LED for emitting light by electrically exciting a fluorescent organic compound, displays images by driving N×M organic light emitting pixels using a voltage programming method or a current programming method. An organic light emitting pixel has a multi-layered structure including an anode layer, an organic thin film layer, and a cathode layer. The organic thin film also has a multi-layered structure including an EMitting Layer (EML), an Electron Transport Layer (ETL), and a Hole Transport Layer (HTL) in order to enhance light emission efficiency by balancing electrons and holes. The organic thin film further include a separate Electron Injecting Layer (EIL) and a separate Hole Injecting Layer (HIL).

Methods for driving the organic light emitting pixels are generally classified into a passive matrix method and an active matrix method using Thin Film Transistors (TFTs). In the passive matrix method, anodes are perpendicular to cathodes and lines are selected and driven, while in the active matrix method, TFTs are coupled to respective pixel electrodes and the TFTs are driven by voltages maintained by capacitors coupled to gates of the TFTs. The active matrix method is classified into a voltage programming method and a current programming method based on the form of a signal which programs a voltage into a capacitor and maintains the programmed voltage.

In an OLED display, one pixel is composed of a plurality of sub pixels having respective colors, so that a color can be represented in various ways by combining colors generated by the plurality of sub pixels. In general, one pixel is composed of a sub pixel representing Red (R), a sub pixel representing Green (G), and a sub color representing Blue (B), and various colors can be represented by combinations of the red, green and blue.

In order to drive these sub pixels, a driving transistor for driving an OLED element for each sub pixel, a switching transistor, and a capacitor are required. In addition to this, a data line for transmitting a data signal and a power line for transmitting an operating voltage are further required. Therefore, there arises an increase in the number of transistors, capacitors, and lines required to form one pixel. Difficulties are encountered in arranging them inside the pixel. In addition, there arises a problem in that an aperture ratio corresponding to a light emitting area of the pixel is reduced.

SUMMARY OF THE INVENTION

In accordance with an exemplary embodiment of the present invention, a light emitting display with an improved aperture ratio is provided.

In accordance with another exemplary embodiment of the present invention, a light emitting display with a simplified configuration and interconnection of devices included in a pixel is provided.

In accordance with one aspect of the present invention, a display panel is provided comprising: a plurality of data lines adapted to transmit a data signal; a plurality of scan lines adapted to transmit a select signal; and a plurality of pixels, each pixel being coupled to one of the plurality of scan lines and one of the plurality of data lines, and each pixel including: a plurality of light emitting elements adapted to emit light corresponding to a current supplied thereto; a pixel driver adapted to input the data signal while the select signal is being supplied and to output a first current corresponding to the data signal; and a plurality of switching units adapted to transmit the first current to the plurality of light emitting elements, each of the plurality of switching units including a plurality of first transistors respectively coupled between the pixel driver and the plurality of light emitting elements, the plurality of first transistors having different respective types of channels.

The pixel driver preferably comprises: a second transistor having first, second, and third electrodes and adapted to output a current to the third electrode, the current corresponding to a voltage supplied between the first and second electrodes; a first capacitor coupled between the first and second electrodes of the second transistor; and a switch adapted to transmit the data signal to the first capacitor in response to the select signal.

The display panel preferably further comprises a first power source coupled to the second electrode of the second transistor; the pixel driver preferably further includes: a second capacitor coupled between the first electrode of the second transistor and the first capacitor; a fourth switch adapted to diode-couple the second transistor in response to a first control signal; and a fifth switch adapted to supply a voltage of the first power source to one electrode of the first capacitor coupled to one electrode of the second capacitor in response to a second control signal.

The first control signal preferably corresponds to the second control signal.

The first control signal preferably comprises a select signal of a previous scan line supplied immediately before a current select signal is supplied.

The plurality of the light emitting elements each preferably comprises first and second light emitting elements adapted to emit light of different respective colors corresponding to a current supplied thereto.

The plurality of switching units each preferably comprises a first switching unit adapted to transmit the first current to the first light emitting element and a second switching unit adapted to transmit the first current to the second light emitting element, each of the first and second switching units preferably respectively including a PMOS transistor and an NMOS transistor coupled in series.

A first emit signal is preferably supplied to a gate electrode of the NMOS transistor in the first switching unit, and an emit signal corresponding to the first emit signal is preferably supplied to a gate electrode of the PMOS transistor in the second switching unit; and a second emit signal is preferably supplied to a gate electrode of the PMOS transistor in the first switching unit, and an emit signal corresponding to the second emit signal is preferably supplied to a gate electrode of the NMOS transistor in the second switching unit.

Each of the pixels preferably comprises first, second and third light emitting elements adapted to respectively emit light of different colors corresponding to a current supplied thereto.

Each of the plurality of switching units preferably comprises first, second and third switching unit adapted to respectively transmit the first current to the first, second and third light emitting elements, each of the first, second and third switching units preferably including three second transistors coupled in series.

In accordance with another aspect of the present invention, a display is provided comprising a display unit including: a plurality of data lines adapted to transmit a data signal; a plurality of scan lines adapted to transmit a select signal; and a plurality of pixels, each pixel being coupled to one of the plurality of scan lines and one of the plurality of data lines a data driver adapted to time-divide the plurality of data signals for one field and to supply the time-divided data signals to the plurality of data lines; and a scan driver adapted to supply the select signal sequentially to the plurality of scan lines; wherein each of the pixels includes: a plurality of light emitting elements adapted to emit light corresponding to a current supplied thereto; a pixel driver adapted to input the data signal while the select signal is being supplied and to output a first current corresponding to the data signal; and a plurality of switching units adapted to respectively transmit the first current to the light emitting elements, each of the switching units including a plurality of transistors respectively coupled in series between the pixel driver and the light emitting elements, and having different type channels.

The one field is preferably divided into a plurality of subfields and the scan driver is preferably adapted to supply the select signal to the plurality of scan lines for each subfield.

The plurality of light emitting elements is preferably adapted to respectively emit light of different colors corresponding to the current supplied thereto, and the data driver is preferably adapted to sequentially supply the data signals corresponding to the plurality of light emitting elements.

The plurality of light emitting elements each preferably comprise first and second light emitting elements adapted to respectively emit light of different colors corresponding to the current supplied thereto, and the plurality of switching units each preferably comprise first and second switching units adapted to respectively transmit the first current to the first and second light emitting elements.

The one field is preferably divided into first and second subfields, the first switching unit adapted to transmit the first current to one of the first and second light emitting elements for a first period of time, and the second switching unit adapted to transmit the first current to one of the first and second light emitting elements for a second period of time.

The data driver and the scan driver are preferably arranged on a display panel on which the display unit is arranged.

In accordance with still another aspect of the present invention, a pixel circuit is provided comprising: a plurality of light emitting elements adapted to emit light corresponding to a current supplied thereto; a driving circuit adapted to input a data signal and to output a first current corresponding to the data signal; a first switching circuit adapted to transmit the first current to one of at least two of the plurality of light emitting elements for a first period of time; and a second switching circuit adapted to transmit the first current to one of the at least two light of the plurality of emitting elements for a second period of time; wherein at least one of the first and second switching circuits includes two transistors having different type channels.

The driving circuit preferably comprises: a transistor having first, second, and third electrodes adapted to output a current to the third electrode, the current corresponding to a voltage supplied between the first and second electrodes; a first capacitor coupled between the first and second electrode of a transistor; and a switch adapted to transmit the data signal to the first capacitor in response to the select signal.

Each of the plurality of light emitting elements is preferably adapted to respectively emit light of different colors corresponding to the current supplied thereto, and each of the first and second switching circuits preferably include two transistors coupled in series.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
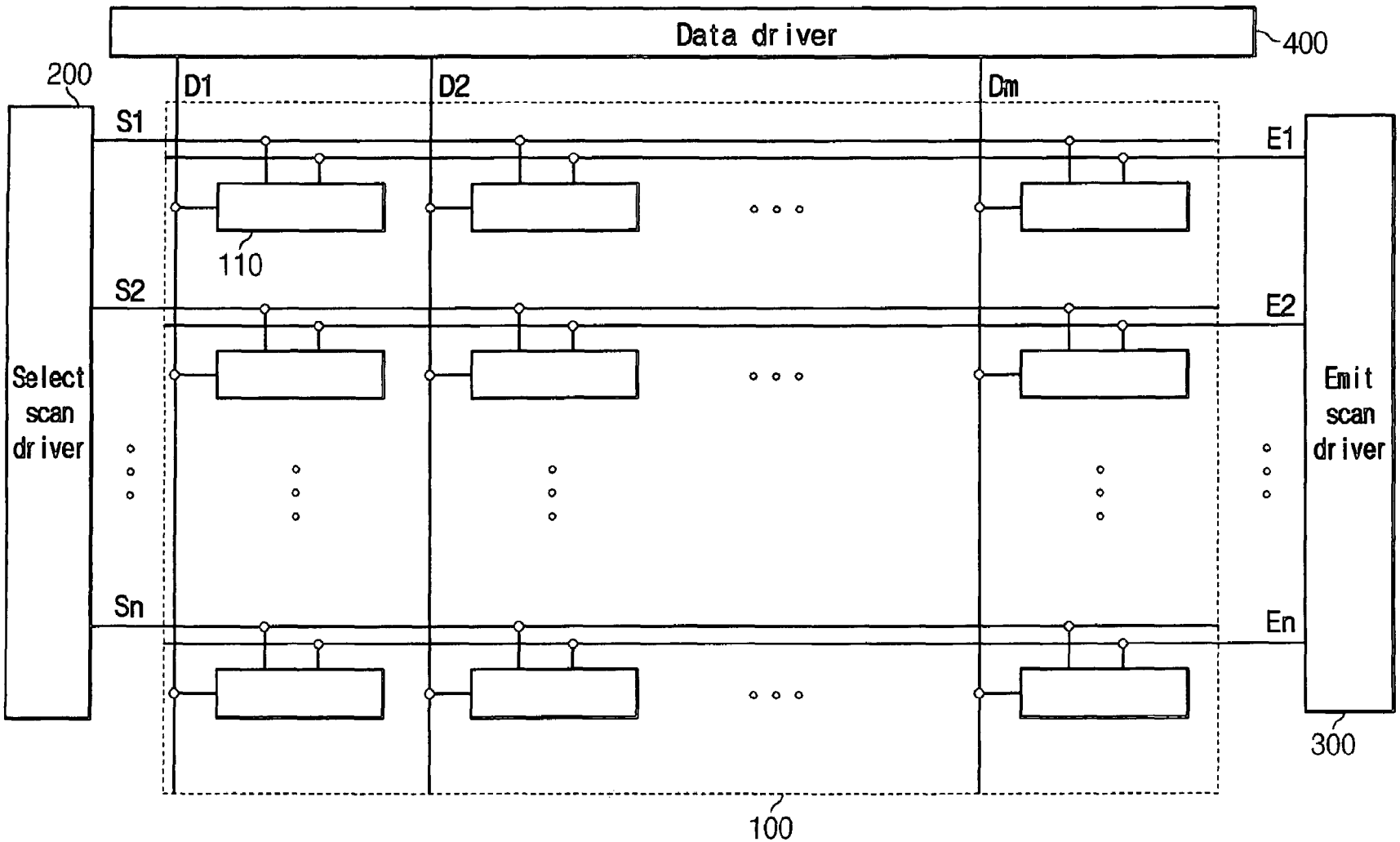
FIG. 1 is a schematic plan view of an OLED display according to a first exemplary embodiment of the present invention.

In the following detailed description, only certain exemplary embodiments of the present invention are shown and described, by way of illustration. As those skilled in the art would recognize, the described exemplary embodiments can be modified in various ways, all without departing from the spirit or scope of the present invention. Accordingly, the drawings and description are to be regarded as illustrative in nature, rather than restrictive.

In the drawings, illustrations of elements having no relation with the present invention have been omitted in order to prevent the subject matter of the present invention from being unclear. In the specification, the same or similar elements are denoted by the same reference numerals even if depicted in different drawings. Also, a coupling between one element and another element includes an indirect coupling with a different element interposed therebetween, as well as a direct coupling therebetween.

A light emitting display and a driving method thereof according to exemplary embodiments of the present invention are described below in detail with reference to the drawings.

Figure 2:
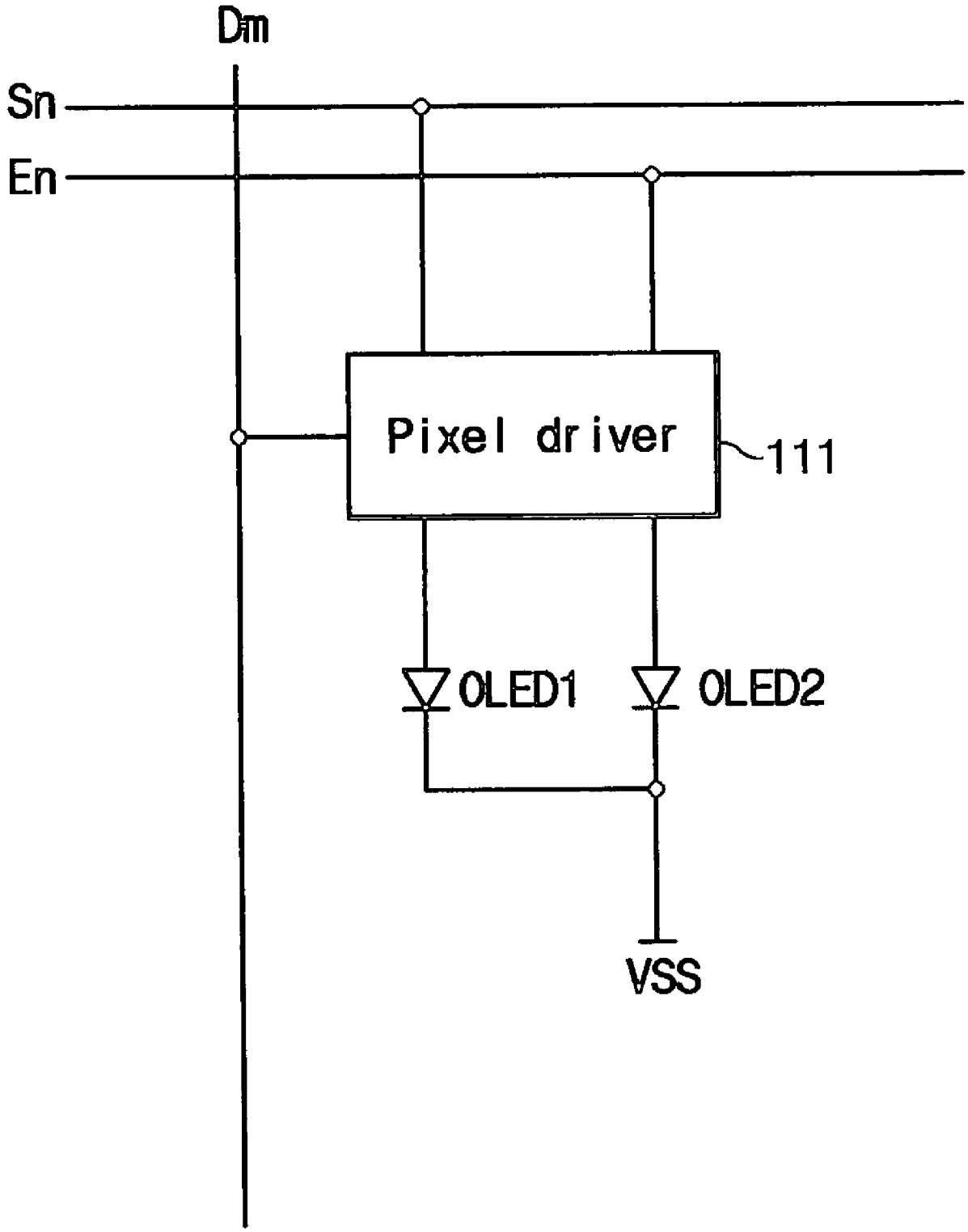
FIG. 2 is a schematic conceptual diagram of a pixel in the OLED display of FIG. 1.

FIG. 1 is a schematic plan view of an OLED display according to a first exemplary embodiment of the present invention, and FIG. 2 is a schematic conceptual diagram of a pixel in the OLED display of FIG. 1.

As shown in FIG. 1, the OLED display according to the first exemplary embodiment of the present invention includes a display panel 100, a select scan driver 200, an emit scan driver 300, and a data driver 400. The display panel 100 includes a plurality of scan lines S1 to Sn and E1 to En extending in a row direction, a plurality of data lines D1 to Dm extending in a column direction, and a plurality of pixels 110. Each pixel 110 is formed in a pixel area defined by two adjacent scan lines S1 to Sn and two adjacent data lines D1 to Dm. Referring to FIG. 2, each pixel 110 includes OLED elements OLED1 and OLED2 for emitting light of different colors, and a pixel driver 111 for driving the OLED elements OLED1 and OLED2. These OLED elements emit light with a brightness corresponding to the amount of current supplied thereto.

The select scan driver 200 sequentially supplies a select signal to the plurality of scan lines S1 to Sn so that the data signal is programmed into a pixel coupled to a corresponding scan line, and the emit scan driver 300 sequentially supplies an emit signal to a plurality of emit scan lines E1 to En in order to control the light emission of the OLED elements OLED1 and OLED2. Also, the data driver 400 supplies the data signal to the data lines D1 to Dm, the data signal corresponding to the pixel of the scan line to which the select signal is supplied, every time the select signal is sequentially supplied.

The select and emit scan drivers 200 and 300 and the data driver 400 are coupled to a substrate on which the display panel 100 is formed. Alternatively, the scan drivers 200 and 300 and/or the data driver 400 can be directly mounted on a glass substrate of the display panel 100, or can be replaced by a driving circuit formed with the same layer as the scan lines, the data lines and transistors. Alternatively, the scan drivers 200 and 300 and/or the data driver 400 can be mounted on a Tape Carrier Package (TCP), a Flexible Printed Circuit (FPC), or a Tape Automatic Bonding (TAB), which is conductively bonded to the substrate of the display panel 100, in the form of a chip.

In the first exemplary embodiment of the present invention, one field is divided into two subfields in each of which data corresponding to respective OLED elements OLED1 and OLED2 is programmed for light emission. To this end, the select scan driver 200 supplies the select signal to the selection scan lines S1 to Sn sequentially for each subfield, and the emit scan driver 300 supplies the emit signal to the emit scan lines E1 to En so that the OLED element emits light with a respective color in a respective subfield. In addition, the data driver 400 supplies data signals corresponding to the OLED elements OLED1 and OLED2, respectively, in two subfields.

Hereinafter, the operation of the OLED display according to the first exemplary embodiment of the present invention is described in detail with reference to FIGS. 3 and 4.

Figure 3:
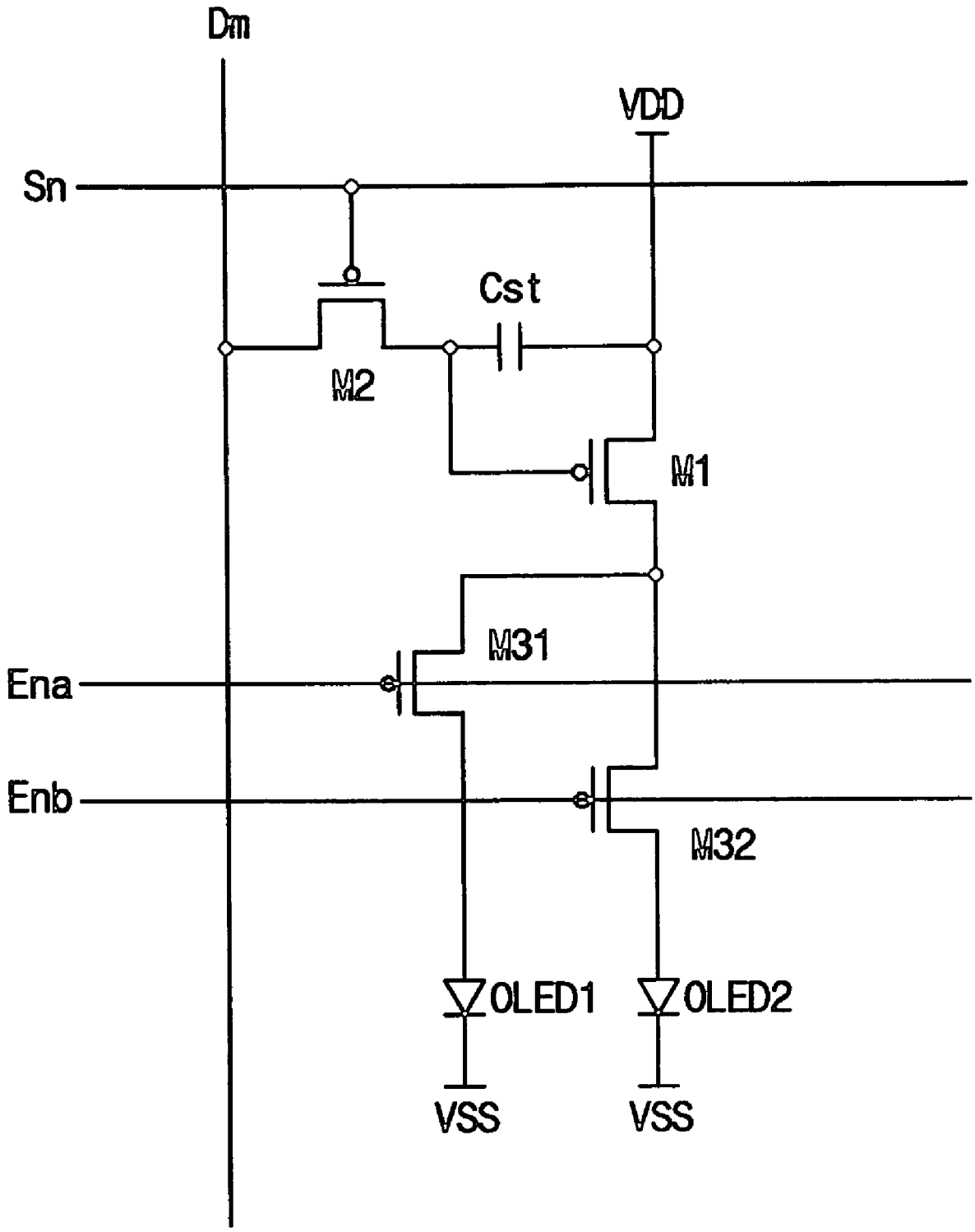
FIG. 3 is a circuit diagram of a pixel in the OLED display according to the first exemplary embodiment of the present invention.
Figure 4:
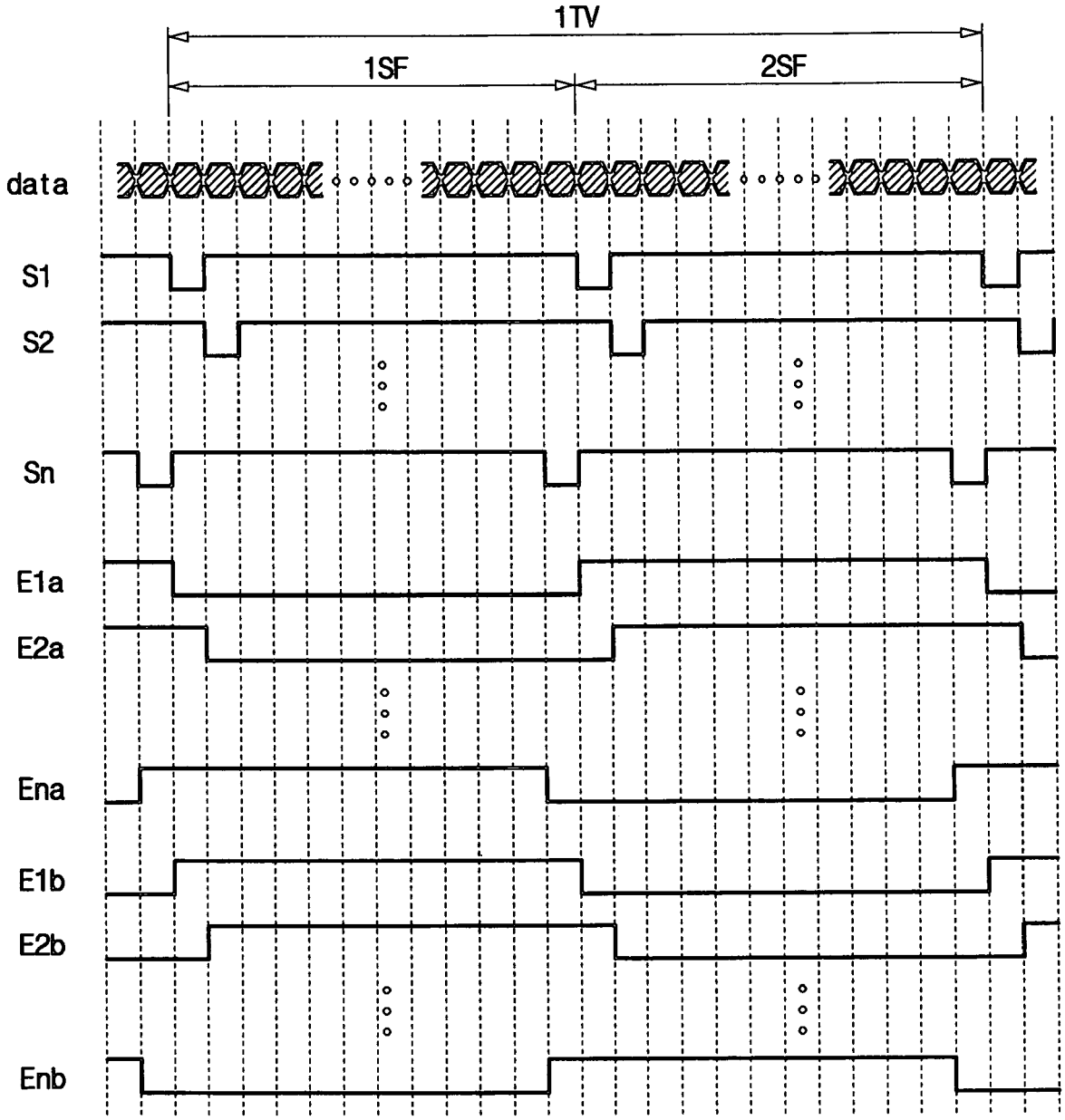
FIG. 4 is a driving timing diagram of the OLED display according to the first exemplary embodiment of the present invention.

FIG. 3 is a circuit diagram of the pixel in the OLED display according to the first exemplary embodiment of the present invention, and FIG. 4 is a driving timing diagram of the OLED display according to the first exemplary embodiment of the present invention.

FIG. 3 shows the pixel employing the voltage programming method in which a selection scan line Sn is coupled to a data line Dm. Transistors used are shown as a p-channel transistors in FIG. 3. Other pixels in the OLED display have the same configuration as the pixel of FIG. 3, and therefore, an explanation thereof has been omitted.

As shown in FIG. 3, the pixel circuit according to the first exemplary embodiment of the present invention includes a driving transistor M1, a switching transistor M2, two OLED element OLED1 and OLED2, and two light emitting transistors M31 and M32 for controlling light emission of the OLED elements OLED1 and OLED2. One light emitting scan line En is composed of two emit signal lines Ena and Enb. Although not shown in FIG. 3, each of the other emit scan lines E1 to E(n−1) is also composed of two emit signal lines. The light emitting transistors M31 and M32 and the emit signal lines Ena and Enb form a switching unit for selectively transmitting a current from the driving transistor M1 to the OLED elements OLED1 and OLED2.

In more detail, the switching transistor M2 with a gate electrode coupled to the selection scan line Sn and a source electrode coupled to the data line Dm transmits a data voltage from the data line Dm in response to the select signal from the selection scan line Sn. The driving transistor M1 has a source electrode coupled to a power line for supplying an operation voltage VDD and a gate electrode coupled to a drain electrode of the switching transistor M2. A capacitor Cst is coupled between the source electrode and the gate electrode of the driving transistor M1. Source electrodes of the light emitting transistors M31 and M32 are coupled to a drain gate of the driving transistor M1, and the emit signal lines Ena and Enb are coupled to gate electrodes of the transistors M31 and M32. Anodes of the OLED elements OLED1 and OLED2 are respectively coupled to drain electrodes of the light emitting transistors M31 and M32, and an operation voltage VSS lower than the operation voltage VDD is supplied to cathodes of the OLED elements OLED1 and OLED2. A negative voltage or a ground voltage can be used as the operation voltage VSS.

The switching transistor M2 transmits the data voltage from the data line Dm to the gate electrode of the driving transistor M1 in response to a select signal of a low level from the selection scan line Sn, and a difference voltage between the data voltage transmitted to the gate electrode of the transistor M1 and the operation voltage VDD is stored in the capacitor Cst. When the light emitting transistor M31 is turned on in response to the emit signal of a low level from the emit signal line Ena, a current corresponding to the voltage stored in the capacitor Cst flows into the OLED element OLED1 through the driving transistor M1. Accordingly, the OLED element OLED1 emits light.

Similarly, when the light emitting transistor M32 is turned on in response to the emit signal of a low level from the emit signal line Enb, a current corresponding to the voltage stored in the capacitor Cst flows into the OLED element OLED2 through the driving transistor M1. Accordingly, the OLED element OLED2 emits light.

The two emit signals are supplied to the two emit signal lines such that one pixel can represent different colors having respective low level periods of time during which the two emit signals do not overlap with each other for one field.

Hereinafter, a driving method of the OLED display according to the first exemplary embodiment of the present invention is described in detail with reference to FIG. 4. As shown in FIG. 4, according to the first exemplary embodiment of the present invention, one field 1TV is composed of two subfields 1SF and 2SF. In the subfields 1SF and 2SF, signals for driving the OLED elements OLED1 and OLED2 in the pixel are respectively supplied. Intervals of the subfields are shown to be equal in FIG. 4.

For the sake of convenience of explanation, it is hereinafter assumed that the OLED element OLED1 represents a red color image and the OLED element OLED2 represents a green color image.

In the subfield 1SF, first, when the select signal of a low level is supplied to a selection scan line S1 in a first row, a data voltage R corresponding to the OLED element OLED1 in a pixel in the first row is supplied to the data lines D1 to Dm.

In addition, the emit signal of a low level is supplied to an emit signal line E1*a* in the first row. Then, the data voltage R is supplied to the capacitor Cst through the switching transistor M2 of each pixel in the first row, and a voltage corresponding to the data voltage R is stored in the capacitor Cst. In addition, the light emitting transistor M31 in the pixel in the first row is turned on, and a current corresponding to a gate-source voltage of the light emitting transistor M31 stored in the capacitor Cst flows into the OLED element OLED 1 representing the red color image through the driving transistor Ml. Accordingly, the OLED element OLED 1 emits red light.

When the select signal of a low level is supplied to a selection scan line S2 in a second row, a data voltage R corresponding to a red color image of a pixel in the second row is supplied to the data lines D1 to Din. In addition, the emit signal of a low level is supplied to an emit signal line E2*a* in the second row. Then, a current corresponding to the data voltage R from the data lines D1 to Dm flows into the OLED element OLED1 representing the red color image in the pixel in the second row. Accordingly, the OLED element OLED1 emits red light.

The data voltage is subsequently supplied to pixels in the third to (n−1)-th rows so that the red OLED element OLED1 emits red light. Finally, when the select signal of a low level is supplied to a selection scan line Sn in an n-th row, a data voltage R corresponding to a red color image of a pixel in the n-th row is supplied to the data lines D1 to Dm, and an emit signal of a low level is supplied to a emit signal line Enr in the n-th row. Then, a current corresponding to the data voltage R from the data lines D1 to Dm flows into the OLED element OLED1 representing the red color image in the pixel in the n-th row. Accordingly, the OLED element OLED1 emits red light.

In this way, in the subfield 1SF, the data voltage R corresponding to the red color image is supplied to each pixel formed in the display panel 100. In addition, the emit signal supplied to the emit signal lines E1*a* to Ena is maintained at a low level for a certain time, and the OLED element OLED1 coupled to the light emitting transistor M31 to which the emit signal is supplied continues to emit light while the emit signal is maintained at the low level. This certain time is shown to be equal to the subfield 1SF in FIG. 4. That is, the red OLED element OLED1 in each pixel emits light with a brightness corresponding to the data voltage supplied for a time corresponding to the subfield 1SF.

In the next subfield 2SF, in a way similar to the previous subfield 1SF, a select signal of a low level is sequentially supplied to selection scan line S1 to Sn in a first row to an n-th row, respectively, and a data voltage corresponding to a green color image of a pixel in a corresponding row is supplied to the data lines D1 to Din when the select signal is supplied to each selection scan line S1 to Sn. Also, in synchronization with the sequential application of the select signal of the low level to the selection scan lines S1 to Sn, an emit signal of a low level is sequentially supplied to emit signal lines E1*b* to Enb. Then, a current corresponding to the supplied data voltage flows into the OLED element OLED2 representing the green color image through the light emitting transistor M32. Accordingly, the OLED element OLED2 emits green light.

In the subfield 2SF, similarly, the emit signal supplied to the emit signal lines E1*b* to Enb is maintained at a low level for a certain time, and the green OLED element OLED2 coupled to the light emitting transistor M32 to which the emit signal is supplied continues to emit light while the emit signal is maintained at the low level. This certain time is shown to be equal to the subfield 2SF in FIG. 4. That is, the green OLED element OLED2 in each pixel emits light with a brightness corresponding to the data voltage supplied for a time corresponding to the subfield 2SF.

In this way, in the driving of the OLED display according to the first exemplary embodiment of the present invention, one field is divided into two subfields to be driven sequentially. In each subfield, only one OLED element representing one color in one pixel emits light. Two OLED elements representing different colors respectively emit light sequentially through two subfields.

Although the OLED display is shown to be driven by a progressive scan method in a single scan in FIG. 4, the present invention is not limited to this, and can use a dual scan method, an interlaced scan method or other scan methods.

In addition, although the pixel circuit employing the voltage programming method using only the switching transistor and the driving transistor has been described in the first exemplary embodiment of the present invention, the present invention can be used with a pixel circuit employing the voltage programming method using a transistor for compensating for a threshold voltage of the driving transistor or a transistor for compensating for a voltage drop, in addition to the switching transistor and the driving transistor, described later.

However, when the pixel circuit according to the first exemplary embodiment of the present invention is used, since the light emitting transistors M31 and M32 are PMOS transistors, gate-source voltages of the transistors M31 and M32 become large when an emit signal of a high level is supplied. This can cause a leakage current to flow into the OLED element.

More specifically, while the emit signal of the low level is supplied to the emit signal line Ena in the subfield 1SF and a current from the transistor M1 flows into the red OLED element OLED1, the emit signal of the high level is supplied to the emit signal line Enb, and accordingly, the current from the transistor M1 is prevented from flowing into the green OLED element OLED2.

However, when the transistor M32 is a PMOS transistor, as shown in FIG. 3, the gate-source voltage of the transistor M32 become large when the emit signal of the high level is supplied to the emit signal line Enb. This causes a leakage current to flow into the OLED element OLED2.

Similarly, although the current from the driving transistor M1 flows into the OLED element OLED2 and must not flow into the OLED element OLED1, there arises a problem of a leakage current flowing into the OLED element OLED2 due to the increased gate-source voltage of the transistor M31.

Therefore, a voltage stored in the capacitor Cst is divided into divided voltages and the divided voltages are respectively supplied to the OLED elements OLED1 and OLED2. This leads to a display of images having undesired gray scales, thereby causing a deterioration of image quality.

Figure 5:
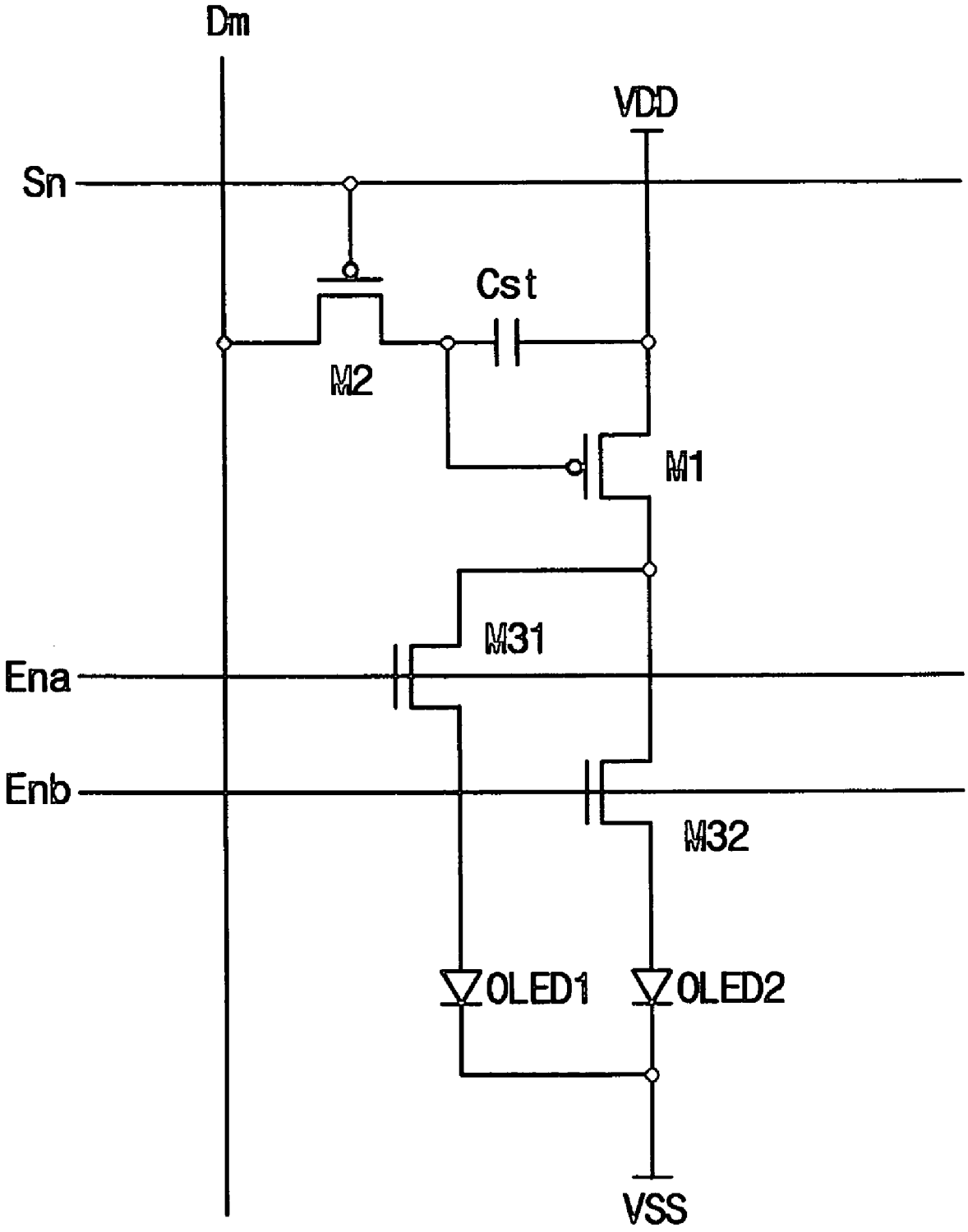
FIG. 5 is a circuit diagram of a pixel in an OLED display according to a second exemplary embodiment of the present invention.

FIG. 5 is a circuit diagram of a pixel in an OLED display according to a second exemplary embodiment of the present invention.

The pixel circuit of the second exemplary embodiment of the present invention is different from the pixel circuit of the first exemplary embodiment in that the light emitting transistors M31 and M32 are NMOS transistors, as shown in FIG. 5.

When the light emitting transistors M31 and M32 are NMOS transistors, the absolute value of the gate-source voltages of the light emitting transistors M31 and M32 is small so that a leakage current can be prevented from flowing into the OLED elements OLED1 and OLED2 even when a low level voltage is supplied to the emit scan lines Ena and Enb and the current from the transistor M1 is interrupted.

However, in order to prevent the leakage current using the NMOS light emitting transistors M31 and M32, the channel lengths of the transistors M31 and M32 must be disadvantageously long.

Accordingly, a third exemplary embodiment of the present invention is provided to overcome a disadvantage of the pixel circuits of the first and second exemplary embodiments by using an NMOS transistor and a PMOS transistor in series for the light emitting transistors.

Figure 6:
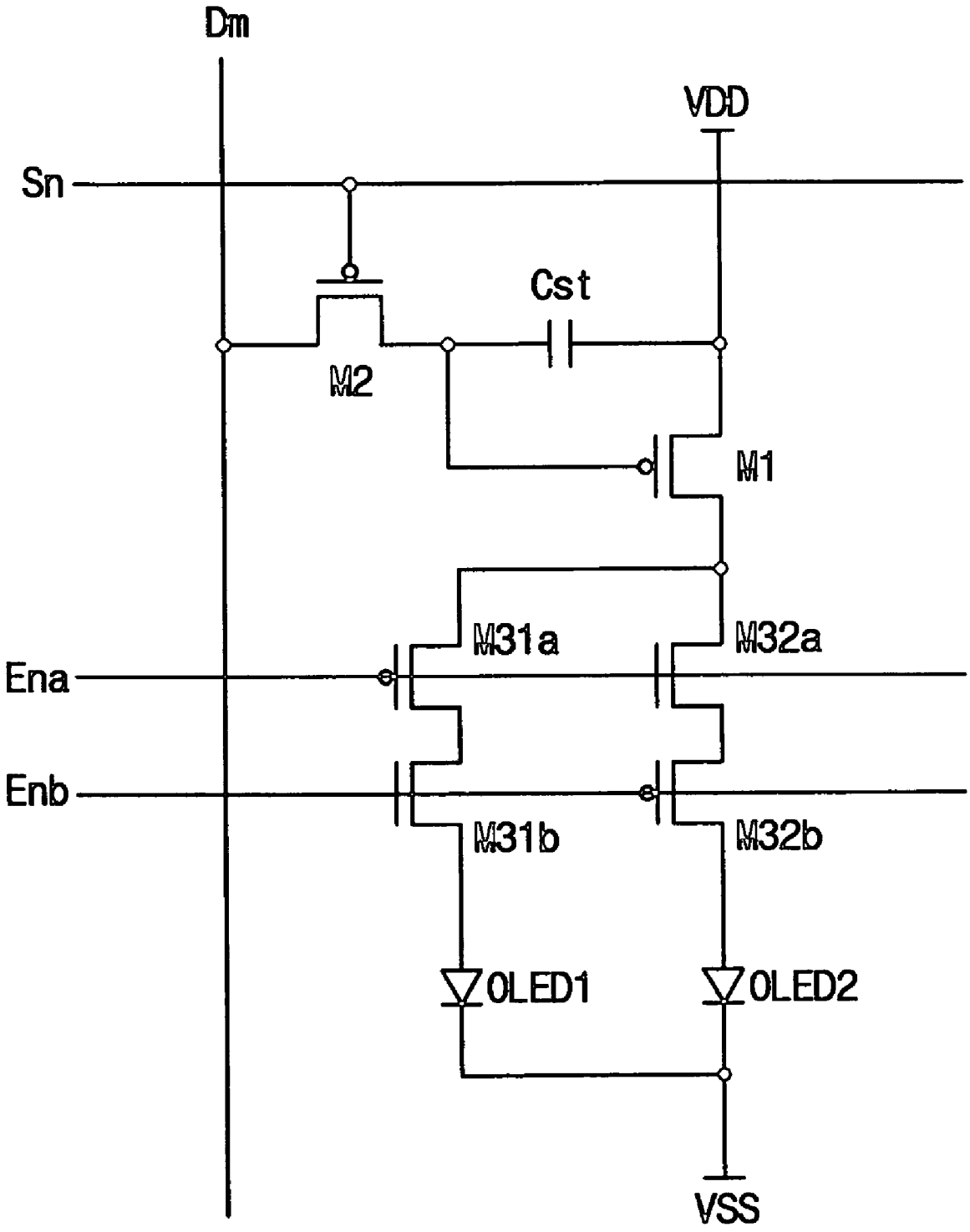
FIG. 6 is a circuit diagram of a pixel in an OLED display according to a third exemplary embodiment of the present invention.

FIG. 6 is a circuit diagram of a pixel in an OLED display according to the third exemplary embodiment of the present invention.

As shown in FIG. 6, transistors M31*a* and M31*b* are coupled in series between a transistor M1 and an OLED element OLED1, and transistors M32*a* and M32*b* are coupled in series between the transistor M1 and an OLED element OLED2.

The transistors M31*a* and M32*b* are PMOS transistors and the transistors M32*a* and M31*b* are NMOS transistors. Gate electrodes of the transistors M31*a* and M32*a* are coupled to a emit signal line Ena and gate electrodes of the transistors M31*b* and M32*b* are coupled to a emit signal line Enb.

Accordingly, in the subfield 1SF, when a low level voltage is supplied to the emit signal line Ena and a high level voltage is supplied to the emit signal line Enb, the transistors M31*a* and M31*b* are turned on and accordingly a current from the transistor M1 flows into the OLED element OLED1. Since the transistors M32*a* and M32*b* coupled to the OLED element OLED2 are interrupted, a leakage current can be effectively prevented from flowing into the OLED element OLED2.

Similarly, in the subfield 2SF, when a high level voltage is supplied to the emit signal line Ena and a low level voltage is supplied to the emit signal line Enb, the transistors M32*a* and M32*b* are turned on and accordingly a current from the transistor M1 flows into the OLED element OLED2. Since the transistors M31*a* and M31*b* coupled to the OLED element OLED1 are interrupted, a leakage current can be effectively prevented from flowing into the OLED element OLED1.

Accordingly, according to the third exemplary embodiment of the present invention, the leakage current flowing into the OLED elements in a non-light emission interval can be significantly reduced using the driving waveforms of FIG. 4. In addition, since two transistors are coupled to each other in series, a channel length of each of the transistors can be short.

Figure 7:
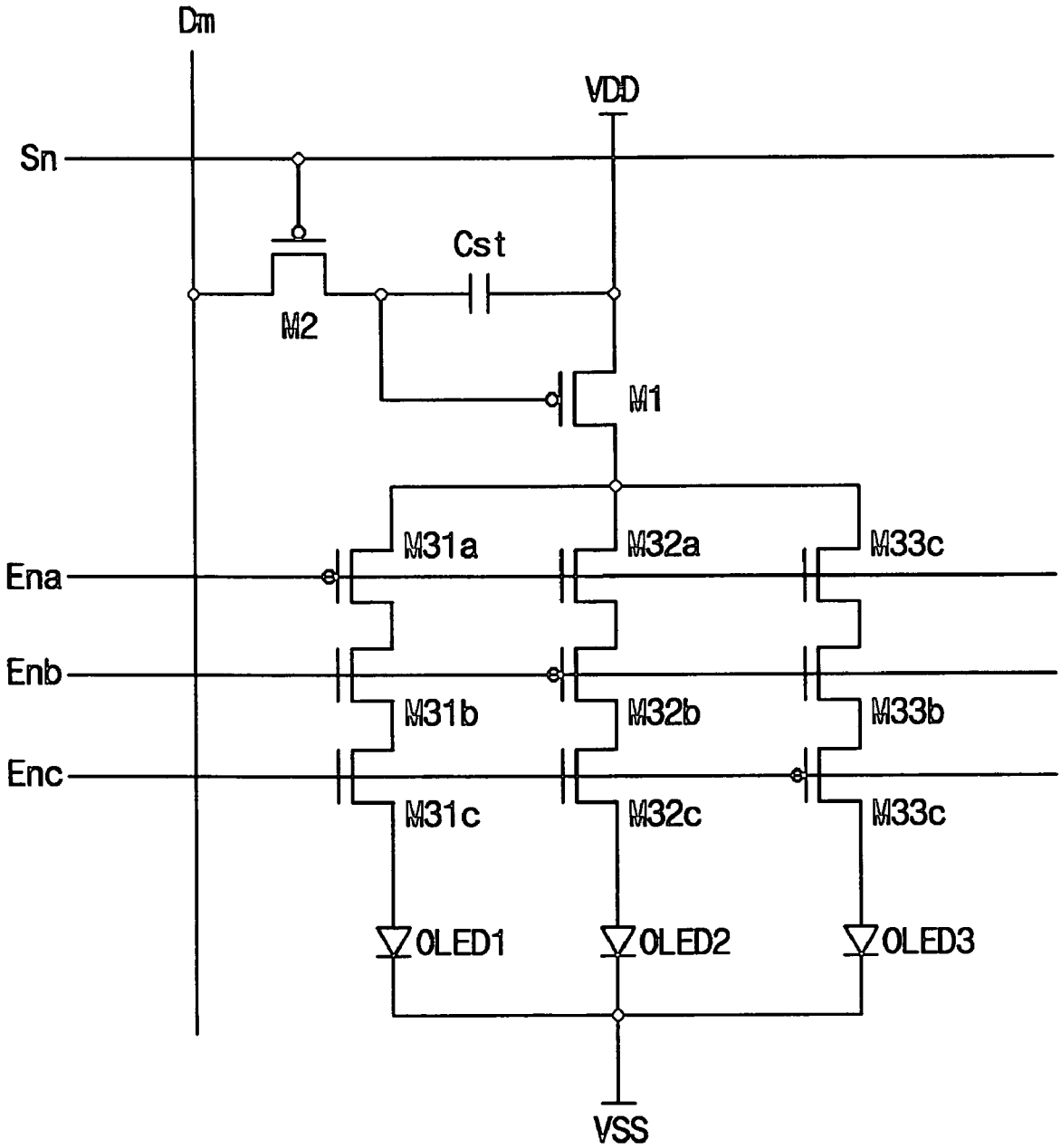
FIG. 7 is a circuit diagram of a pixel in an OLED display according to a fourth exemplary embodiment of the present invention.

FIG. 7 is a circuit diagram of a pixel in an OLED display according to a fourth exemplary embodiment of the present invention.

As shown in FIG. 7, the pixel circuit of the fourth exemplary embodiment of the present invention is different from the pixel circuit of the third exemplary embodiment in that three OLED elements OLED1, OLED2 and OLED3 are coupled to one driver, and three light emitting transistors are coupled in series between a driving transistor M1 and the OLED elements OLED1, OLED2 and OLED3, respectively.

When the three OLED elements OLED1, OLED2 and OLED3 are coupled to one driver, one field is divided into three subfields, and signals for driving the OLED elements OLED1, OLED2 and OLED3 are supplied in each subfield.

More specifically, in a first subfield, when a low level voltage is supplied to an emit signal line Ena and a high level voltage is supplied to emit signal lines Enb and Enc, transistors M31*a* to M31*c* are turned on and accordingly a current from the transistor M1 flows into the OLED element OLED1.

In addition, an NMOS transistor M32*a* and a PMOS transistor M32*b* coupled to the OLED element OLED2 are turned off and accordingly a current from the driving transistor M1 is prevented from flowing into the OLED element OLED2. Also, an NMOS transistor M33*a* and a PMOS transistor M33*c* coupled to the OLED element OLED3 are turned off and accordingly the current from the driving transistor M1 is prevented from flowing into the OLED element OLED3.

Accordingly, in the first subfield, only the OLED element OLED1 emits light with a gray scale corresponding to a data voltage, and the OLED elements OLED2 and OLED3 do not emit light since a current does not flow into them.

A leakage current can be prevented from flowing into the OLED elements OLED2 and OLED3 since the NMOS transistors and the PMOS transistors coupled to the OLED elements OLED2 and OLED3 interrupt the leakage current from the OLED elements OLED2 and OLED3.

Similarly, in a second subfield, when a low level voltage is supplied to the emit signal line Enb and a high level voltage is supplied to the emit signal lines Ena and Enc, only the OLED element OLED2 emits light and the remaining OLED elements OLED1 and OLED3 do not emit light. Similarly, in a third subfield, when a low level voltage is supplied to the emit signal line Enc and a high level voltage is supplied to the emit signal lines Ena and Enb, only the OLED element OLED3 emits light.

Accordingly, when one driver drives three OLED elements by respectively coupling three light emitting transistors in series between the driving transistor and the OLED elements, a leakage current flowing into the OLED elements can be minimized, and, by interrupting a current from the OLED elements using an NMOS transistor and a PMOS transistor coupled to each other in series, a channel length of each transistor can be short.

Figure 8:
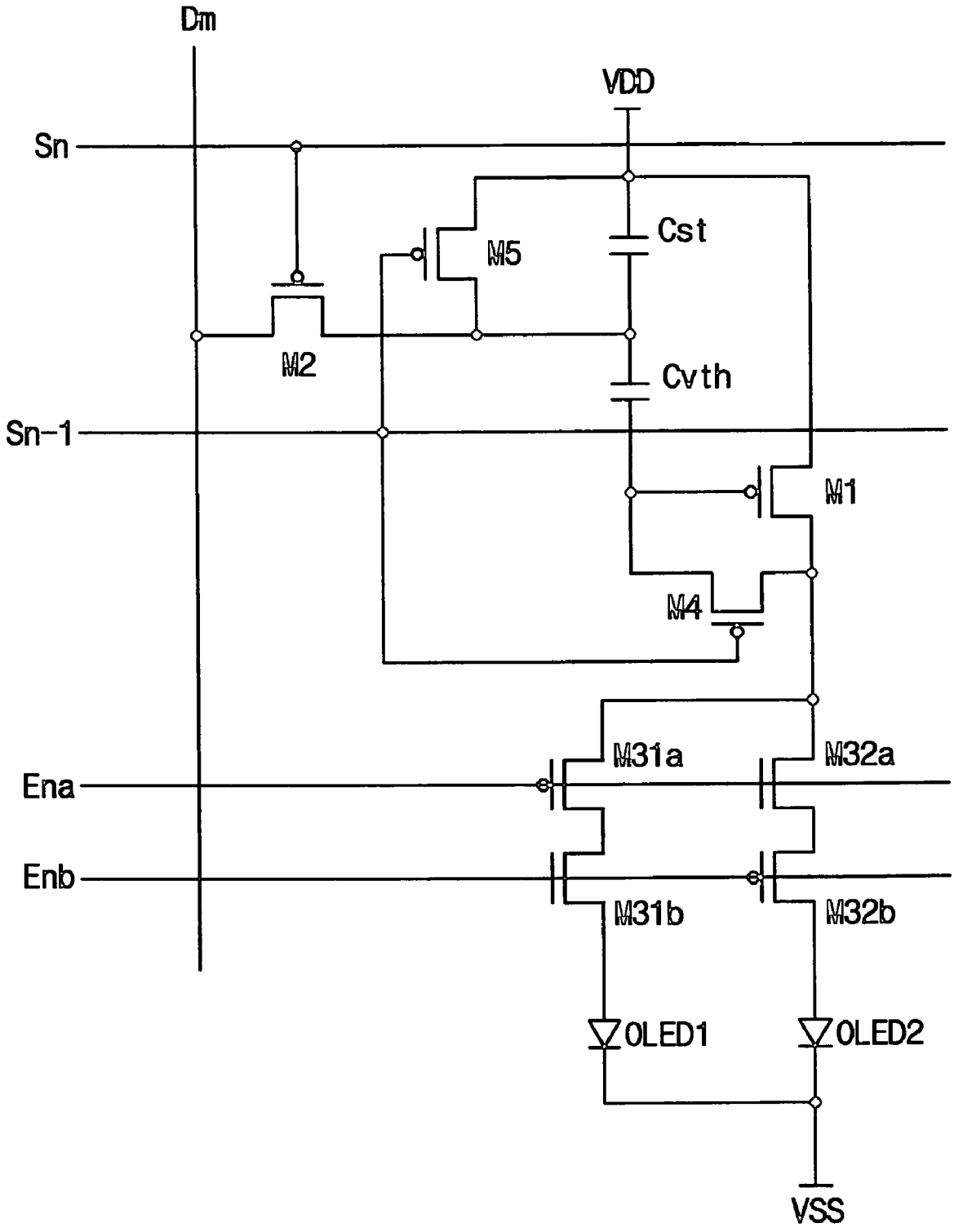
FIG. 8 is a circuit diagram of a pixel in an OLED display according to a fifth exemplary embodiment of the present invention.

FIG. 8 is a circuit diagram of a pixel in an OLED display according to a fifth exemplary embodiment of the present invention.

As shown in FIG. 8, the pixel circuit of the fifth exemplary embodiment of the present invention is different from the pixel circuit of the third exemplary embodiment in that a driver further includes transistors for compensating for a deviation of the threshold voltage of the driving transistor M1, and a capacitor Cvth.

In the pixel circuit of the third exemplary embodiment, the current flowing into the OLED elements is affected by the threshold voltage VTH of the driving transistor M1. Accordingly, if there is a deviation of the threshold voltage between thin film transistors due to a non-uniformity in a manufacturing process of the transistors, it is difficult to attain high gray scales.

Accordingly, in the fifth exemplary embodiment of the present invention, the threshold voltage $V_{TH}$ of the driving transistor M1 is compensated for such that a current flowing into the OLED elements is not affected by the threshold voltage $V_{TH}$ of the driving transistor M1

Hereinafter, the pixel circuit of the fifth exemplary embodiment of the present invention is described in detail. An explanation of portions overlapping with contents of the third exemplary embodiment have been omitted. A selection scan line through which a current select signal is transmitted is called a "current scan line" and a selection scan line through a select signal is transmitted immediately prior to the transmission of the current select signal is called a "just-prior scan line".

A capacitor Cvth is coupled between a gate electrode of a transistor M1 and a capacitor Cst. A transistor M4 is coupled between the gate electrode and a drain electrode of the transistor M1 and diode-couples the transistor M1 in response to a select signal from a just-prior scan line Sn-1. In addition, a transistor M5 is coupled in parallel to the capacitor Cst and supplies an operation voltage VDD to one electrode of the capacitor Cvth in response to the select signal from the just-prior scan line Sn-1.

When a low level voltage is supplied to the just-prior scan line Sn-1, the transistor M4 is turned on and the transistor M1 goes into a diode-coupling state. The transistor M5 is turned on and the threshold voltage of the transistor M1 is stored in the capacitor. Cvth.

Thereafter, when a low level voltage is supplied to a current scan line Sn, a transistor M2 is turned on and a data voltage Vdata charges the capacitor Cst. Since the threshold voltage Vth of the transistor M1 is stored in the capacitor Cvth, a voltage corresponding to the sum of the data voltage Vdata and the threshold voltage Vth of the transistor M1 is supplied to the gate electrode of the transistor M1.

When a low level voltage is supplied to one of emit scan lines Ena and Enb and corresponding light emitting transistors M31 and M32 are turned on, OLED elements emit light based on a current flowing into the OLED elements. The current is expressed by the following Equation 1.

$$\begin{aligned} I_{OLED} &= \frac{\beta}{2}(Vgs - Vth)^2 \\ &= \frac{\beta}{2}((Vdata + Vth - VDD) - Vth)^2 \\ &= \frac{\beta}{2}(VDD - Vdata)^2 \end{aligned} \quad \text{<Equation 1>}$$

wherein $I_{OLED}$ is a current flowing into an OLED element, Vgs is a source-gate voltage of the transistor M1, Vth is a threshold voltage of the transistor M1, Vdata is a data voltage, and β is a constant value.

Since the current flowing into the OLED elements is not affected by the threshold voltage of the transistor M1, images with a desired gray scale can be displayed.

As apparent from the above description, by driving a plurality of OLED elements using a single driver, the present invention provides a light emitting display with an improved aperture ratio.

In addition, the present invention provides a light emitting display with a simplified configuration and interconnection of devices included in a pixel.

Furthermore, the present invention provides a light emitting display with an improved image quality by preventing a leakage current from flowing into OLED elements in a non-light emission interval.

While the present invention has been described in connection with the OLED display as certain exemplary embodiments, the present invention can be adapted to other displays requiring other power supplies. Therefore, it is to be understood that the present invention is not limited to the disclosed embodiments, but, on the contrary, is intended to cover various modifications and equivalent arrangements included within the spirit and scope of the appended claims.

For example, although FIG. 6 shows two light emitting transistors coupled in series between the driving transistor and the OLED elements, and FIG. 7 shows three light emitting transistors coupled in series between the driving transistor and the OLED elements, the present invention is not limited thereto and the number of light emitting transistors can be varied.

In addition, although p-channel driving transistors have been described in the exemplary embodiments, n-channel driving transistors can also be used in other embodiments of the present invention. In other embodiments of the present invention, the driving transistors can be implemented using other active devices, instead of the MOS transistors, including first to third electrodes for controlling a current outputted from the third electrode in response to a voltage supplied between the first and second electrodes.

What is claimed is:

1. A display panel, comprising:

a plurality of data lines adapted to transmit data signals;

a plurality of scan lines adapted to transmit select signals; and a plurality of pixels, each pixel being coupled to one of the plurality of scan lines and one of the plurality of data lines, and each pixel comprising:

a plurality of light emitting elements adapted to emit light corresponding to a current supplied thereto;

a pixel driver adapted to input the data signal while the select signal is being supplied and to output a first current corresponding to the data signal; and a plurality of switching units adapted to transmit the first current to the plurality of light emitting elements, each of the plurality of switching units comprising a plurality of first transistors respectively coupled between the pixel driver and the plurality of light emitting elements, the plurality of first transistors having different respective types of channels.

2. The display panel of claim 1, wherein the pixel driver comprises:

a second transistor having first, second, and third electrodes and adapted to output a current to the third electrode, the current corresponding to a voltage supplied between the first and second electrodes;

a first capacitor coupled between the first and second electrodes of the second transistor; and a switch adapted to transmit the data signal to the first capacitor in response to the select signal.

3. The display panel of claim 2, further comprising a first power source coupled to the second electrode of the second transistor;

wherein the pixel driver further comprises:

a second capacitor coupled between the first electrode of the second transistor and the first capacitor;

a fourth switch adapted to diode-couple the second transistor in response to a first control signal; and a fifth switch adapted to supply a voltage of the first power source to between one electrode of the second capacitor, and one electrode of the first capacitor in response to a second control signal.

4. The display panel of claim 3, wherein the first control signal is substantially equal to the second control signal.

5. The display panel of claim 4, wherein the first control signal is a select signal of a previous scan line supplied immediately before the select signal is supplied.

6. The display panel of claim 1, wherein the plurality of the light emitting elements comprises first and second light emitting elements adapted to emit light of different respective colors corresponding to a current supplied thereto.

7. The display panel of claim 6, wherein the plurality of switching units each comprises a first switching unit adapted to transmit the first current to the first light emitting element and a second switching unit adapted to transmit the first current to the second light emitting element, each of the first and second switching units respectively comprising a PMOS transistor and an NMOS transistor coupled in series.

8. The display panel of claim 7, wherein:

a first emit signal is supplied to a gate electrode of the NMOS transistor in the first switching unit, and an emit signal being substantially equal to the first emit signal is supplied to a gate electrode of the PMOS transistor in the second switching unit; and a second emit signal is supplied to a gate electrode of the PMOS transistor in the first switching unit, and an emit signal being substantially equal to the second emit signal is supplied to a gate electrode of the NMOS transistor in the second switching unit.

9. The display panel of claim 1, wherein each of the pixels comprises first, second and third light emitting elements adapted to respectively emit light of different colors corresponding to a current supplied thereto.

10. The display panel of claim 9, wherein each of the plurality of switching units comprises first, second and third switching units adapted to respectively transmit the first current to the first, second and third light emitting elements, each of the first, second and third switching units comprising three second transistors coupled in series.

11. A display, comprising:

a display unit comprising:

a plurality of data lines adapted to transmit a data signal;

a plurality of scan lines adapted to transmit a select signal; and a plurality of pixels, each pixel being coupled to one of the plurality of scan lines and one of the plurality of data lines;

a data driver adapted to time-divide the plurality of data signals for one field and to supply the time-divided data signals to the plurality of data lines; and a scan driver adapted to supply the select signal sequentially to the plurality of scan lines;

wherein each of the pixels comprises:

a plurality of light emitting elements adapted to emit light corresponding to a current supplied thereto;

a pixel driver adapted to input the data signal while the select signal is being supplied and to output a first current corresponding to the data signal; and a plurality of switching units adapted to respectively transmit the first current to the light emitting elements, each of the switching units comprising a plurality of transistors respectively coupled in series between the pixel driver and the light emitting elements, and having different type channels.

12. The display of claim 11, wherein the one field is divided into a plurality of subfields and wherein the scan driver is adapted to supply the select signal to the plurality of scan lines for each subfield.

13. The display of claim 12, wherein the plurality of light emitting elements is adapted to respectively emit light of different colors corresponding to the current supplied thereto, and wherein the data driver is adapted to sequentially supply the data signals corresponding to the plurality of light emitting elements.

14. The display of claim 11, wherein the plurality of light emitting elements comprise first and second light emitting elements adapted to respectively emit light of different colors corresponding to the current supplied thereto, and wherein the plurality of switching units each comprise first and second switching units adapted to respectively transmit the first current to the first and second light emitting elements.

15. The display of claim 14, wherein the one field is divided into first and second subfields, the first switching unit adapted to transmit the first current to one of the first and second light emitting elements for a first period of time, and the second switching unit adapted to transmit the first current to one of the first and second light emitting elements for a second period of time.

16. The display of claim 11, wherein the data driver and the scan driver are arranged on a display panel on which the display unit is arranged.

17. A pixel circuit, comprising:

a plurality of light emitting elements adapted to emit light corresponding to a current supplied thereto;

a driving circuit adapted to input a data signal and to output a first current corresponding to the data signal;

a first switching circuit adapted to transmit the first current to one of at least two of the plurality of light emitting elements for a first period of time; and a second switching circuit adapted to transmit the first current to one of the at least two of the plurality of light emitting elements for a second period of time;

wherein at least one of the first and second switching circuits comprises two transistors having different type channels.

18. The pixel circuit of claim 17, wherein the driving circuit comprises:

a transistor having first, second, and third electrodes adapted to output a current to the third electrode, the current corresponding to a voltage supplied between the first and second electrodes;

a first capacitor coupled between the first and second electrode of a transistor; and a switch adapted to transmit the data signal to the first capacitor in response to the select signal.

19. The pixel circuit of claim 17, wherein each of the plurality of light emitting elements is adapted to respectively emit light of different colors corresponding to the current supplied thereto, and wherein each of the first and second switching circuits comprise two transistors coupled in series.

* * * * *